US006933090B2

(12) United States Patent
Inagaki et al.

(10) Patent No.: US 6,933,090 B2
(45) Date of Patent: Aug. 23, 2005

(54) PHOTOSENSITIVE MEMBER FOR ELECTROPHOTOGRAPHY

(75) Inventors: Keiichi Inagaki, Hino (JP); Shigeaki Tokutake, Hachioji (JP); Takeshi Ishida, Tama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 10/732,229

(22) Filed: Dec. 11, 2003

(65) Prior Publication Data

US 2005/0019682 A1 Jan. 27, 2005

(30) Foreign Application Priority Data

Jul. 22, 2003 (JP) ..... 2003-199664

(51) Int. Cl.[7] ..... G03G 5/047; G03G 5/147

(52) U.S. Cl. ..... 430/59.6; 430/58.05; 430/58.2; 430/66; 430/67

(58) Field of Search ..... 430/66, 67, 58.05, 430/58.2, 59.6

(56) References Cited

U.S. PATENT DOCUMENTS

| | | | | |
|---|---|---|---|---|
| 4,663,259 | A | 5/1987 | Fujimura et al. | |
| 5,436,701 | A | 7/1995 | Shimojo et al. | |
| 6,258,499 | B1 * | 7/2001 | Itami | 430/66 |
| 6,511,542 | B2 * | 1/2003 | Inagaki | 118/404 |

FOREIGN PATENT DOCUMENTS

| | | |
|---|---|---|
| JP | 8-328287 | 12/1996 |

OTHER PUBLICATIONS

Japanese Patent Office machine–assisted translation of JP 08–328287 (pub. Dec. 1996).*

* cited by examiner

*Primary Examiner*—Janis L. Dote
(74) *Attorney, Agent, or Firm*—Burns, Doane, Swecker & Mathis, LLP

(57) ABSTRACT

The present invention relates to a photosensitive member for electrophotography which comprises a electroconductive support and one or more layers that include a photosensitive layer formed on the surface of the electroconductive support, wherein the outermost layer comprises binder resin, fluororesin particles A and fluororesin particles B.

20 Claims, No Drawings

PHOTOSENSITIVE MEMBER FOR ELECTROPHOTOGRAPHY

RELATED APPLICATIONS

This disclosure is based upon Japanese Patent Application No. 2003-199664, filed Jul. 22, 2003, the contents of which are incorporated herein by reference.

BACKGROUND OF THE INVENTION

1. Field of the Invention

The present invention relates to a photosensitive member for electrophotography.

2. Description of the Related Art

In general, a photosensitive member for electrophotography comprises an electroconductive support on which a photosensitive layer and a surface protection layer, if desired, are formed. Because external mechanical force is applied to the surface of the photosensitive member when a toner image formed thereon is transferred to a transfer medium such as paper, or when the residual toner is cleaned off of the photosensitive member, photosensitive members are required to have surface durability against wear and impact (wear-resistance). Accordingly, a technology is known in which, in order to improve the wear-resistance of the conventional photosensitive member, the outermost surface layer of the photosensitive member is embedded with small particles of a fluorine-containing resin (hereinafter, referred to as "fluororesin") such as polytetrafluoroethlyene (PTFE) resin.

In particular, a technology has been reported (see, for example, Japanese Patent Application Laid-Open No. 8-328287) in which fluororesin particles having a low degree of crystallinity (i.e., an X-ray diffraction pattern peak half-value width of 0.28 or higher) are used as means to effectively reduce the friction coefficient of the surface of the photosensitive member and improve wear-resistance. However, this technology entails the problem that it is difficult to disperse the fluororesin particles evenly in the dispersion solution and agglomerations appear in the layer containing these particles, creating defects in the coating and significantly reducing the quality of image from the outset of initial printing.

Another known technology uses small-diameter fluororesin particles as means to effectively reduce the friction coefficient of the surface of the photosensitive member. When small-diameter particles are used, the surface area increases even where an equal number of parts by weight of the particles are added, effectively reducing the friction coefficient. However, such fluororesin particles do not disperse evenly even when they have a small diameter. It is difficult to form a smooth and even coating having no agglomerations, and the quality of the image from the outset of initial printing is significantly reduced.

OBJECT AND SUMMARY

An object of the present invention is to provide an photosensitive member that offers superior durability against surface wear and damage (wear-resistance) and uniform dispersion of the fluororesin particles within the surface layer, as well as the ability to form good quality images over a long period of time.

The present invention relates to a photosensitive member for electrophotography which comprises a electroconductive support and one or more layers that include a photosensitive layer formed on the surface of the electroconductive support, wherein (i) the outermost layer comprises binder resin, fluororesin particles A and fluororesin particles B, (ii) the fluororesin particles A have an average primary diameter of less than 0.2 μm and a peak half-value width of the X-ray diffraction pattern of not less than 0.36, (iii) the fluororesin particles B have an average primary diameter of not less than 0.2 μm and a peak half-value width of the X-ray diffraction pattern of less than 0.36, and (iv) a weight ratio of the fluororesin particles A and the fluororesin particles B is within 8:2 to 2:8.

The present invention further relates to a photosensitive member for electrophotography comprising a charge generating layer, a first charge transfer layer and a second charge transfer layer laminated on a electroconductive support in this order, wherein (i) the second charge transfer layer comprises binder resin, a charge transfer material, fluororesin particles A and fluororesin particles B, (ii) the fluororesin particles A have an average primary diameter of less than 0.2 μm and a peak half-value width of the X-ray diffraction pattern of not less than 0.36, (iii) the fluororesin particles B have an average primary diameter of not less than 0.2 μm and a peak half-value width of the X-ray diffraction pattern of less than 0.36, and (iv) a weight ratio of the fluororesin particles A and the fluororesin particles B is within 8:2 to 2:8.

DETAILED DESCRIPTION OF THE INVENTION

The photosensitive member of the present invention comprises a photosensitive layer formed on a electroconductive support, and has at least two specified types of fluororesin particles in the outermost surface layer of the photosensitive member.

The construction of the photosensitive member of the present invention is not limited in any particular fashion so long as it includes at least two specified types of fluororesin particles in the outermost surface layer thereof, and may consist of any of the following constructions, for example:

(1) a construction in which a charge generating layer and a charge transfer layer are laminated sequentially on a electroconductive support as constituent layers of the photosensitive layer;

(2) a construction in which a charge generating layer, a first charge transfer layer and a second charge transfer layer are laminated sequentially on a electroconductive support as constituent layers of the photosensitive layer;

(3) a construction in which a single layer including a charge transfer material and a charge generating material is formed on a electroconductive support as the photosensitive layer;

(4) a construction in which a charge transfer layer and a charge generating layer are laminated sequentially on a electroconductive support as constituent layers of the photosensitive layer; or (5) a construction in which a surface protection layer is formed over the photosensitive layer of the photosensitive member having any of the constructions (1) through (4) described above.

Where the photosensitive member has any of the constructions described above, the outermost layer of the photosensitive member contains at least two specified types of fluororesin particles. The outermost surface layer of the photosensitive member is the layer with which the toner comes in direct contact during developing, in which a toner image is formed based on a latent image existing on the photosensitive member. For example, where only a photosensitive layer comprising multiple laminated layers is formed on the electroconductive support, the outermost layer of the photosensitive layer is the outermost surface layer, while where a single-layer photosensitive layer only is formed on the electroconductive support, the photosensitive layer constitutes the outermost surface layer. Where a single-layer or multi-layer photosensitive layer and a surface protection layer are laminated on a electroconductive support, the surface protection layer is the outermost surface layer. Therefore, in the present invention, at least two specified types of fluororesin particles are present in the following layer: specifically, in the construction (1) above, the charge transfer layer; in the construction (2) above, the second charge transfer layer; in the construction (3) above, the single layer that includes a charge transfer material and a charge generating material; in the construction (4) above, the charge generating layer; and in the construction (5) above, the surface protection layer. Furthermore, it is acceptable if the photosensitive member of the present invention includes a sub-layer that is formed on the electroconductive support prior to the formation of the photosensitive layer regardless of the construction used.

The case in which the photosensitive member of the present invention has the construction (2) above will be described in detail below, but this description may apply to the other four constructions as well, taking into consideration the fact that such other constructions involve different formation sequences for the various layers and/or different combinations of materials comprising the various layers.

The electroconductive support of the present invention may consist of a conductive body having a volume resistance of no more than $1\times10^{10}$ Ωcm, e.g., film-shaped or cylindrical plastic or paper coated with a metal such as aluminum, nickel, chrome, copper, silver, gold or platinum or a metal oxide such as tin oxide or indium oxide using deposition or sputtering, a plate formed from aluminum, aluminum alloy, nickel or stainless steel, or a tube or the like that was formed using any of such plates via processing such as D.I. (direct injection), I.I. (indirect injection), extrusion or drawing and surface-finished via machining, super-finishing or polishing.

It is acceptable if a sub-layer is formed on the electroconductive support prior to the formation of the charge-generating layer. In general, the sub-layer is composed primarily of resin, and considering that the photosensitive layer is to be applied on top of the resin comprising this layer using a solvent, it is preferred that the resin consist of a resin that is highly insoluble with respect to general organic solvents. This resin may constitute a water-soluble or alcohol-soluble resin such as polyamide, polyvinyl alcohol, nylon copolymer, methoxymethylated nylon, polybutyl butyral or polyacrylate, or a curable resin such as polyurethane, melamine resin, alkyd-melamine resin or epoxy resin. Furthermore, from the standpoint of effectively reducing residual potential and preventing moire, it is acceptable if powder made of a metal oxide such as titanium oxide, silica, alumina, zirconium oxide, tin oxide or indium oxide is added to the sub-layer. The sub-layer can be formed using a suitable solvent and a public-domain method of application. Alternatively, a deposited film of aluminum oxide, zinc oxide or silicon oxide may be used as the sub-layer. It is preferred that the sub-layer has a thickness not exceeding 10 μm.

The charge generating layer is a layer composed primarily of a charge generating material. While either an organic charge generating material or an inorganic charge generating material may be used as the charge generating material, it is preferred that an organic charge generating material be used. A public-domain charge generating material may be used as the organic charge generating material. For example, such material may comprise a phthalocyanine pigment such as metal phthalocyanine or non-metal phthalocyanine, an azulenium salt pigment, a squaric acid methine pigment, an azo pigment with a carbazole skeleton, an azo pigment with a triphenylamine skeleton, an azo pigment with a diphenylamine skeleton, an azo pigment with a dibenzothiophene skeleton, an azo pigment with a fluorenone skeleton, an azo pigment with an oxadiazole skeleton, an azo pigment with a bis-stilbene skeleton, an azo pigment with a distyryl oxydiazole skeleton, an azo pigment with a distyryl carbazole skeleton, a perylene pigment, an anthraquinone or polycyclic quinone pigment, a quinone imine pigment, a diphenyl methane or triphenyl methane pigment, a benzoquinone or naphthoquinone pigment, a cyanine or azomethine pigment, an indigoid pigment, or a bis-benzimidazole pigment. It is preferred that a phthalocyanine pigment be used, and even more preferred that a metal phthalocyanine, particularly titanylphthalocyanine, be used. These charge generating materials may be used individually or in combinations of two or more.

An binder resin may be used in the charge generating layer where necessary, and in this case, the above organic charge generating material or inorganic charge generating material is dispersed or dissolved in the binder resin to form the charge generating layer. It is preferred that the amount of charge generating material contained in the charge generating layer constitute 50 to 300 parts by weight to 100 parts by weight of binder resin. The binder resin contained in the charge generating layer may constitute, for example, polyamide, polyurethane, epoxy resin, polyketone, polycarbonate, silicone resin, acrylic resin, polyvinyl butyral (butyral resin), polyvinyl formal, polyvinyl ketone, polystyrene, poly-N-vinyl carbazole or polyacrylamide. It is preferred that polyvinyl butyral be used. These substances may be used individually or in combinations of two or more.

The methods for forming the charge-generating layer may be broadly classified into vacuum thin film fabrication methods and casting methods that use a solution dispersion system. Vacuum thin film fabrication methods include such methods as the vacuum deposition method, the glow discharge decomposition method, the ion plating method, the sputtering method, the reaction sputtering method, and the CVD method. The charge-generating layer can be successfully formed using any of the organic or inorganic charge generating materials described above or a combination thereof. When forming the charge generating layer using a casting method, a charge generating layer application solution is prepared by dispersing in a solvent such as tetrahydrofuran cyclohexanone, dioxan, dichloroethane or butanone any of the organic or inorganic charge generating materials described above, or a combination thereof, as well as an binder resin, if necessary, by means of a ball mill, attritor or sand mill, and by applying the solution on a electroconductive support or a sub-layer and drying it. The application method is not limited to any particular method, and any public-domain method such as the immersion application method, the spray application method, the ring application method, the spinner application method, the roller application method, the Meyerbar application method, the blade application method or the bead application method may be used. The proper thickness of the charge-generating layer formed in this way is between 0.01 and 5 μm, and preferably ranges between 0.05 and 2 μm.

The first charge transfer layer contains an binder resin and a charge transfer material, and preferably also contains additives such as an oxidation inhibitor and a leveling agent.

The binder resin used in the first charge transfer layer is not limited to any particular resin. For example, polyester, polyurethane, polyallylate, polyethylene, polystyrene, polybutadiene, polycarbonate, polyamide, polypropylene, polyimide, polyamide imide, polysulfone, polyallyl ether, polyacetal, polyvinyl acetate, polysiloxane, polymethyl methacrylate, phenoxy resin, fluororesin, nylon, phenol resin, acryl resin, silicone resin, epoxy resin, urea resin, allyl resin, alkyd resin, butyral resin or the like may be used individually, or copolymers or mixtures of two or more of these substances may be used.

Of the above substances, polycarbonate is preferred as the binder resin for the first charge transfer layer, and denatured polycarbonate (I) expressed by the following formula (I) is particularly preferred.

(I)

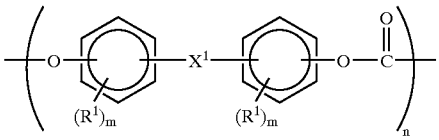

(In the formula, $R^1$ represents a halogen atom, an alkyl group having a carbon number from 1 to 6, or a substituted or non-substituted aromatic hydrocarbon radical having a carbon number from 6 to 12, wherein the multiple $R^1$'s are either the same or different; (m) represents an integer from 0 to 4, wherein the multiple m's are either the same or different, and preferably 0; (n) is a value that will achieve the viscosity mean molecular weight described below; and $X^1$ is a 1,1-cycloalkylene group having a carbon number from 3 to 8, —$C(CF_3)(CF_3)$— or —$C(R^2)(R^3)$— (in the formula, at least either $R^2$ or $R^3$ is a substituted or non-substituted aromatic hydrocarbon radical having a carbon number from 6 to 12, while the other is a hydrogen atom or a alkyl group having a carbon number from 2 to 6), and preferably 1, 1-cyclohexylene group, —$C(CF_3)(CF_3)$—, —CH(Ph)— (Ph is a phenyl group here and below), or —C(Ph)(Ph)—, particularly 1, 1-cyclohexylene group).

Preferred specific examples of the denatured polycarbonate (I) are those expressed by the formulae (I-1)–(I-4).

(I-1)

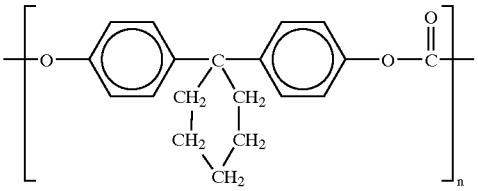

(I-2)

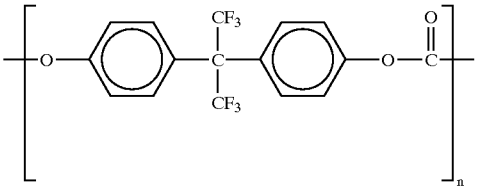

-continued (I-3)

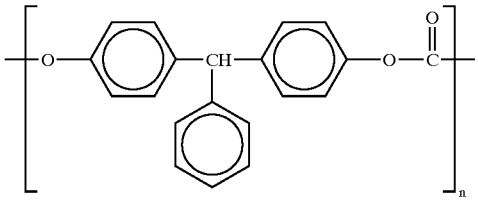

(I-4)

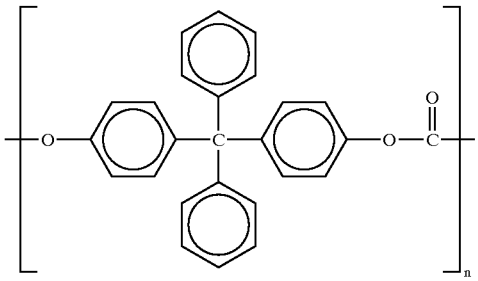

The particularly preferred example of the denatured polycarbonate (I) is the denatured polycarbonate expressed by the above general formula (I-1), which is generally called Z polycarbonate resin.

The viscosity mean molecular weight of denatured polycarbonate (I) preferably ranges between 20,000 and 100,000, and more preferably between 30,000 and 80,000.

TS2020 and TS2050 (expressed by the above general formula (I-1); made by Teijin Chemicals Ltd.) and IUPILON Z300, Z500 and Z800 (expressed by the above general formula (I-1); made by Mitsubishi Engineering Plastics Corp.) are available on the market as denatured polycarbonate (I), for example.

Any substance that can move electron holes may be used for the charge transfer material of the first charge transfer layer. For example, an oxazole derivative, an oxadiazole derivative, an imidazole derivative, a monoallylamine derivative, a diallylamine derivative, a triallylamine derivative, a stilbene derivative, an α-phenylstilbene derivative, a benzidine derivative, a diallylmethane derivative, a triallylmethane derivative, a 9-styrylanthracene derivative, a pyrazoline derivative, a divinylbenzene derivative, a hydrazone derivative, an indene derivative or a butadiene derivative may be used. The content of the charge transfer material is not limited to any particular value to 100 parts by weight of the binder resin in the first charge transfer layer, but it is usually 2 to 200 parts by weight, and preferably 3 to 120 parts by weight.

For the oxidation inhibitor used in the first charge transfer layer, various oxidation inhibitors that are contained in the photosensitive layer of an organic photosensitive member in the conventional art may be used. For example, such oxidation inhibitors include hindered phenols, hindered amines, benzotriazoles, organic sulfur compounds, organic phosphate compounds and hydroquinones.

Specific examples of hindered phenols include, for example, monophenolic compounds such as 2,6-di-t-butyl-p-cresol, butylated hydroxyanisole, 2,6-di-t-butyl-4-ethylphenol, 2,6-di-t-butyl-4-phenylphenol, 2,6-di-t-butyl-4-phenylmethylphenol, stearyl-6-(3,5-di-t-butyl-4-hydroxyphenol)propionate, 2,6-di-t-butyl-4-(4,6-bis(octylthio)-1,3,5-triazine-2-ylamino)phenol, 2,4-bis-(n-octylthio)-6-(4-hydroxy-3,5-di-t-butylanilino)-1,3,5-triazine; bisphenolic compounds such as 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidene bis-(3-methyl-6-t-butyl phenol), and 2,2-thiodiethylene bis-[3-(3,5-di-t-butyl-4-hydroxyphenyl) propionate]; polymer phenolic compounds such as 1,1,3-tris-(2-methyl-4-hydroxy-5-t-butylphenol)butane, 1,3,5-trimethyl-2,4,6-tris(3,5-di-t-butyl-4-hydroxybenzyl) benzene, tris(3,5-di-t-butyl-4-hydroxybenzyl)isocyanulate, tetrakis-[metylene-3-(3',5'-di-t-butyl-4'-hydroxy phenyl) propionate]methane, bis[3,3'-bis(4'-hydroxy-3'-t-butylphenyl)butylic acid]glycol ester, and tocophenols.

Specific examples of hindered amines include, for example, paraphenylenediamine compounds such as N-phenyl-N'-isopropyl-p-phenylenediamine, N,N'-di-sec-butyl-p-phenylenediamine, N-phenyl-N-sec-butyl-p-phenylene diamine, N,N'-di-isopropyl-p-phenylenediamine, and N,N'-dimethyl-N,N'-di-t-butyl-p-phenylene diamine; and piperidine compounds such as bis (2,2,6,6-tetra methyl-4-piperidyl)sebacate, 1-[2-{3-(3,5-t-butyl-4-hydroxyphenyl)propionyloxi}ethyl]-4-{3,(3,5-t-butyl-4-hydroxylphenyl)propionyloxi}-2,2,6,6-tetra methyl piperidine, poly[{6-(1,1,3,3-tetramethylbutyl)amino-1,3,5-triazine-2,4-diyl}, {(2,2,6,6-tetramethyl-4-piperidyl) imino}hexamethylene {(2,2,6,6-tetramethyl-4-piperidyl) imino}], dimethylsuccinate-1-(2-hydroxyethyl)-4-hydroxyl-2,2,6,6-tetramethylpiperdine polycondensation, and N,N'-bis(3-aminopropyl)ethylenediamine-2,4-bis[N-butyl-N-(1, 2,2,6,6-pentamethyl-4piperidyl) amino-6-chloro-1,3,5-triazine condensation.

Specific examples of benzotriazoles include, for example, 2-(5-methyl-2-hydroxylphenyl)benzotriazole, 2-(3,5-di-t-butyl-2-hydroxyphenyl) benzotriazole, 2-(3,5-di-t-amyl-2-hydroxyphenyl)benzotriazole, hydroxyphenylbenzotriazole derivatives, condensates with methyl-3-[3-t-butyl-5-(2H-benzotriazole-2-yl)-4-hydroxyphenyl]propionate-polyethylene glycol (molecular weight: approximately 300), and 2-(2H-benzotriazole-2-yl)-4-methyl-6-(3,4,5,6-tetrahydrophthalimidylmethyl) phenol.

Specific examples of organic sulfur compounds include, for example, dilauryl-3,3'-thiodipropionate, distearyl-3,3'-thiodipropionate, and ditetradecyl-3,3'-thiodipropionate.

Specific examples of organic phosphate compounds include, for example, triphenylphosphine, tri(nonyl phenyl) phosphine, tri(dinonylphenyl)phosphine, tricresylphosphine, tri(2,4-diputyl phenoxy)phosphine.

Specific examples of hydroquinones include, for example, 2,5-di-t-octylhydroquinone, 2,6-didodecyl hydroquinone, 2-dodecylhydroquinone, 2-dodecyl-5-chloro hydroquinone, 2-t-octyl-5-methylhydroquinone, and 2-(2-octadecenyl)-5-methylhydroquinone.

For the oxidation inhibitor in the first charge transfer layer, of the compounds shown above, it is preferred that one or more compounds selected from among hindered phenols, hindered amines and benzotriazoles be used. It is further preferred from the standpoint of manufacturing cost, including pot life, that a hindered phenol, particularly monophenolic compound, be used individually.

It is preferred that the content of the oxidation inhibitor in the first charge transfer layer range between 0.1 and 25% by weight relative to the charge transfer material, and particularly between 0.8 and 15% by weight, in order to prevent the residual potential from increasing due to long-term use and to improve sensitivity. The oxidation inhibitor may be added to the charge generating layer or the sub-layer described above.

For the leveling agent, silicone oil such as dimethyl silicone oil or methyl phenyl silicone oil may be used.

The first charge transfer layer is usually formed by first preparing an application solution by dissolving or dispersing an binder resin and a charge transfer material in a solvent together with desired additives (such as an oxidation inhibitor) and by applying the solution onto the charge generating layer and drying it. The application method is not limited to any particular method, and any of the same methods shown as examples as the methods that may be used for the formation of the charge generating layer may be used.

The second charge transfer layer is composed of at least specified fluororesin particles A and B, a binder resin and a charge transfer material. In the present invention, by using the fluororesin particles A and B described below in combination, the uniformity of the fluororesin particle dispersal in the dispersion solution significantly improves, such that a layer having superior particle dispersal uniformity with no agglomerations (coating defects) can be easily formed. As a result, the intrinsic effect of fluororesin particles, i.e., the effect of making the surface of the photosensitive member slippery, can be successfully obtained, thereby improving the photosensitive member's durability against wear and damage (wear-resistance) and cleanability, as well as increasing the ease of toner separation. If only the fluororesin particles A are used, the uniformity of the particle dispersal in the dispersion solution decreases, preventing formation of a layer with no agglomerations (coating defects) and therefore resulting in a marked deterioration in image quality. If only fluororesin particles B are used, the effect of imparting slipperiness during printing is not obtained to the same degree as when both particles A and B are used, resulting in a reduction in wear-resistance and cleanability. Such reduction leads to the occurrence of striations on the surface of the photosensitive member and on the image.

The fluororesin particles A have an average primary particle diameter of less than 0.2 $\mu$m, preferably no more than 0.15 $\mu$m, with an X-ray diffraction pattern peak ($2\theta$=18) half-value width of at least 0.36, and preferably at least 0.37. If the particle diameter is too large, the effect of making the surface of the photosensitive member slippery is reduced, leading to a decline in wear-resistance and cleanability at the outset. Furthermore, exposure light becomes scattered, causing a reduction in the sensitivity of the photosensitive member and a decline in the resolution. If the half-value width is too small, the effect of imparting slipperiness during printing decreases significantly, leading to a decline in wear-resistance and cleanability, and highly visible striations appear on the surface of the photosensitive member and the image. The lower limit of the average primary particle diameter range for the fluororesin particles A is not limited to any particular value so long as the object of the present invention is achieved, but from the standpoint of ease of obtaining such particles, it is preferred that the lower limit be no lower than 0.01 $\mu$m. Furthermore, the upper limit of the X-ray diffraction pattern peak half-value width is not limited to any particular value so long as the object of the present invention is achieved, but from the standpoint of ease of obtaining such particles, it is preferred that the upper limit be no higher than 0.50, and more preferably no higher than 0.42.

The fluororesin particles B have an average primary particle diameter of at least 0.2 μm, preferably 0.25 μm or higher, with an X-ray diffraction pattern peak (2θ=18) half-value width of less than 0.36, and preferably less than 0.32. If the particle diameter is too small, the uniformity of particle dispersal in the dispersion solution deteriorates, giving rise to partial agglomerations (coating defects) and causing a decline in image quality. If the half-value width becomes too large, image quality deteriorates significantly because the uniformity of particle dispersal in the particle dispersion solution is substantially reduced, preventing the formation of a layer having no agglomerations. The upper limit of the average primary particle diameter range for the fluororesin particles B is not limited to any particular value so long as the object of the present invention is achieved, but from the standpoint of sensitivity reduction, it is preferred that the upper limit be no higher than 0.39 μm. Furthermore, the lower limit of the X-ray diffraction pattern peak half-value width is not limited to lower particular value so long as the object of the present invention is achieved, but from the standpoint of ease of obtaining such particles, it is preferred that the lower limit be no lower than 0.10.

In this Specification, the average primary particle diameter refers to a value measured by a DLS-6000 spectrophotometer (made by Otsuka Electronics Co., Ltd.) using the dynamic light scattering method. However, the particle diameter need not be measured using this apparatus only, and measurement may be performed by any apparatus that can perform measurement based on the same principle as that used by the above apparatus, or using the laser diffraction method or the centrifugal precipitation method.

The X-ray diffraction pattern peak half-value width is a value that depends on the degree of crystallinity of the material. The degree of crystallinity increases as the half-value width decreases, and decreases as the half-value width increases. Specifically, the half-value width is the difference between two points on the horizontal axis before and after the peak at which the intensity is half of that at the peak in an X-ray diffraction pattern (vertical axis (intensity)—horizontal axis (2θ)).

The half-value width can be calculated from the X-ray diffraction pattern measured at 2θ=18 by an X-ray diffractometer (such as an RU-200B diffractometer made by Rigaku Corp.).

The half-value width can be increased via heating. For example, if PTFE particles having an average primary particle diameter of 0.3 μm and a half-value width of 0.313 are subjected to heating for 30 minutes at 250° C., the half-value width becomes 0.355. The heating means is not limited to a particular type, and a public domain dryer or heater may be used.

The fluororesin particles A and B consist of a homopolymer or copolymer of a polymerizing fluoromonomer, or of a copolymer of a polymerizing fluoromonomer and a polymerizing fluoro-free monomer. A polymerizing fluoromonomer is a monomer expressed by means of the following formula:

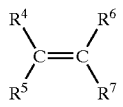

(In the formula, at least one of $R^4$ to $R^7$ is a fluorine atom, while the remaining groups are mutually independent and consist of a hydrogen atom, a chlorine atom, the methyl group, the monofluoromethyl group, the difluoromethyl group or the trifluoromethyl group.) Preferred polymerizing fluoromonomers include tetrafluoroethylene, trifluoroethylene, trifluoroethylene dichloride, hexafluoropropylene, vinyl fluoride, vinylidene fluoride and difluoroethylene dichloride. Two or more monomers may be used as the polymerizing fluoromonomers.

Polymerizing fluoro-free monomers include, for example, vinyl chloride and the like. Two or more monomers may be used as the polymerizing fluoro-free monomers.

Both the fluororesin particles A and the fluororesin particles B preferably constitutes a polymerizing fluoromonomer homopolymer or copolymer, and more preferably constitutes polytetrafluoroethylene (PTFE), polytrifluoroethylene,tetrafluoroethylene-hexafluoropropylene copolymer or polyvinilydene fluoride. Polytetrafluoroethylene is particularly preferred.

The average molecular weight of the copolymer constituting the fluororesin particles A and B is not limited to a particular value so long as the object of the present invention is achieved, but normally it should fall within a range between 100,000 and 1,000,000.

For these fluororesin particles A, the commercially available material TF9207 (PTFE, made by Sumitomo 3M Ltd.) may be used.

For the fluororesin particles B, the commercially available material KTL-500F (PTFE, made by Kitamura Ltd.) or L-2 (PTFE, made by Daikin Industries Ltd.) may be used.

The relative weight ratio of the fluororesin particles A and B ranges between 8:2 and 2:8, and preferably between 7:3 and 3:7. If the relative percentage by weight of the fluororesin particles A is too large, the uniformity of dispersal within the dispersion solution deteriorates, preventing the formation of a layer having no agglomerations (coating defects) and resulting in a significant decline in image quality. If the percentage by weight of the fluororesin particles A is too small, the effect of imparting slipperiness during printing decreases significantly, leading to a decline in wear-resistance and cleanability, and striations appear on the surface of the photosensitive member and on the image.

From the standpoint of further improving the effect of making the photosensitive member slippery and increasing dispersal uniformity, the total content of the fluororesin particles A and B should range from 10 to 150 parts by weight to 100 parts by weight of the binder resin in the second charge transfer layer or in the outermost layer or in the outermost layer. A range of 50 to 100 parts by weight is particularly preferred.

The binder resin containing in the second charge transfer layer and in is not limited to any particular type, and any of the binder resins described as examples in connection with the first charge transfer layer may be used. From the standpoint of further improving the uniformity of fluororesin particle dispersal, the preferred binder resin is polycarbonate, particularly siloxane denatured polycarbonate that has the recurring part expressed by the following general formula (II). Said polycarbonate having the recurring part expressed by the general formula (II) can also be used as the binder resin in the outermost layer.

(II)

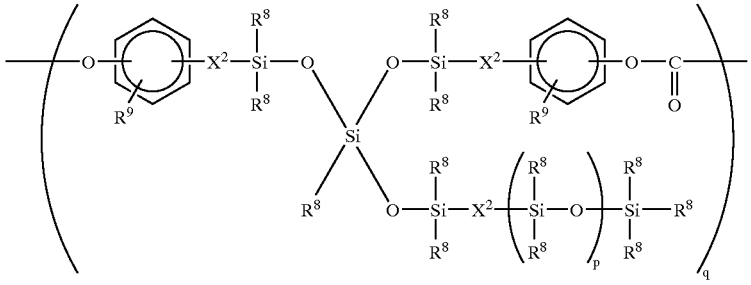

(In the formula, $R^8$ represents an alkyl group having a carbon number from 1 to 6 or a substituted or non-substituted aromatic hydrocarbon radical having a carbon number from 6 to 12, and preferably an alkyl group having a carbon number from 1 to 6, particularly a methyl group, wherein the multiple $R^8$'s may be either the same or different; $R^9$ represents a hydrogen atom, a halogen atom, an alkyl group having a carbon number from 1 to 6, or a substituted or non-substituted aromatic hydrocarbon radical having a carbon number from 6 to 12, and preferably a hydrogen atom or an alkyl group having a carbon number from 1 to 6, particularly a hydrogen atom, wherein the multiple $R^9$'s may be the same or different; $X^2$ is $(CH_2)_k$, wherein the multiple $X^2$'s may be the same or different; (k) is an integer from 1 to 6, preferably 2 or 3; (p) ranges between 0 and 200, and preferably between 5 and 100; and (q) ranges between 1 and 50).

The viscosity mean molecular weight of siloxane denatured polycarbonate is preferably between 20,000 and 100,000, and more preferably between 30,000 and 80,000.

The siloxane denatured polycarbonate may constitute, for example, formulations G-300, G-400 or G700 (made by Idemitsu Kosan Co., Ltd.).

The charge transfer material used in the second charge transfer layer may be one of the same charge transfer materials described as examples in connection with the first charge transfer material. The amount of charge transfer material contained in the second charge transfer layer to 100 parts by weight of binder resin is not limited to any particular value, but a content of 5 to 300 parts by weight, and particularly 10 to 200 parts by weight, is usually preferred.

It is preferred that the second charge transfer layer further includes additives such as an oxidation inhibitor, a leveling agent and the like. For the oxidation inhibitor and leveling solution, the same substances described as examples in connection with the first charge transfer layer may be used in the second charge transfer layer as well. The amount of oxidation inhibitor and leveling solution contained in the second charge transfer layer is not limited to any particular value, but it is preferred that the amount of oxidation inhibitor comprise 0.01 to 200% by weight relative to the amount of charge transfer material, and more preferably 0.1 to 100% by weight.

The second charge transfer layer may be formed using any method that achieves the object of the present invention. It is preferred that the method described below be used.

First, the binder resin and charge transfer material are dissolved or dispersed in a solvent together with the desired additives (oxidation inhibitor, leveling solution, etc.). The solvent is not limited to any particular substance so long as it permits dissolution of the binder resin, but from an environmental standpoint, a dehalogenated solvent is desirable, and it is preferred that toluene, tetrahydrofuran, 1,3-dioxolane or cyclohxanone, or a mixture thereof, be used as the solvent.

Next, a solution in which the separately-prepared fluororesin particles A and B are mixed and dispersed is added to the obtained solution, and the two solutions are mixed in order to disperse the particles and obtain an application solution. The solution containing the mixture of the fluororesin particles A and B may be prepared by mixing together two dispersion solutions in which the fluororesin particles A and B are separately dispersed (i.e., a dispersion solution containing fluororesin particles A and a dispersion solution containing fluororesin particles B). The dispersion solvent used for the fluororesin particle A dispersion solution and the dispersion solvent used for the fluororesin particle B dispersion solution are not limited to any particular substance, but from the standpoint of improving the uniformity of fluororesin particle dispersal, toluene is preferred. The content of fluororesin particles in the particle A and B dispersion solutions preferably constitutes 0.1 to 70% by weight of the entire solution, and more preferably 0.5 to 60% by weight of the entire solution. It is furthermore preferred that a dispersion promoting agent such as fluorochemical surfactant, fluorine group-containing graft polymer, fluorine group-containing coupling solution or the like be added. By dissolving such a promoting agent in the dispersion solution, the uniformity of fluororesin particle dispersal can be further improved. The total amount of fluororesin particles in the dispersion solution containing the fluororesin particles A and B is preferably 0.1 to 70% by weight, and more preferably 0.5 to 60% by weight of the entire solution. The means for dissolving or dispersing each material, and particularly the means for dispersing the fluororesin particles, may be a sand mill, ball mill, roll mill, homogenizer, nanomizer, paint shaker, ultrasound, sand grinder or the like.

The obtained application solution is then applied on the first charge transfer layer and dried, whereby the second charge transfer layer is formed. The same application method used with the first charge transfer layer may be used with the second charge transfer layer.

EXAMPLES

Unless otherwise specified, 'parts' below means 'parts by weight'.

Example 1

A electroconductive support constituting a cylindrical alumite tube having an outer diameter of 30 mm and a length of 285 mm was used.

One part of butyral resin (S-LEC BX-1; made by Sekisui Chemical Co., Ltd.) and one part of m-type titanylphthalocyanine (am-TiOPc; made by Toyo Ink Mfg. Co., Ltd.) were added to 100 parts of tetrahydrofuran and dispersed for five minutes using a sand mill, thereby creating a charge generating layer application solution, and this application solution was then applied to the above support body via immersion to form a charge generating layer having a film thickness of 0.2 μm.

A first charge transfer layer application solution was prepared by dissolving 120 parts of Z polycarbonate resin (IUPILON Z-300; made by Mitsubishi Engineering Plastics Corp.), 80 parts of a charge transfer material expressed via the following general formula (i), (i)

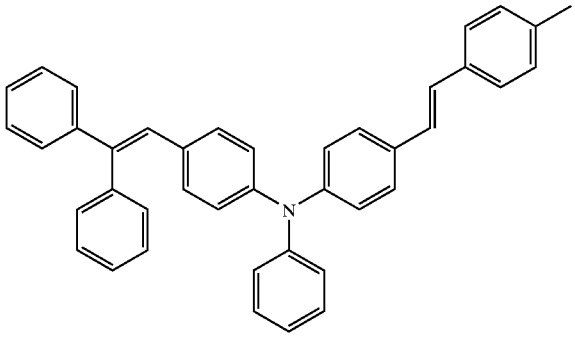

2.4 parts of an oxidation inhibitor expressed by the following general formula (ii), (ii)

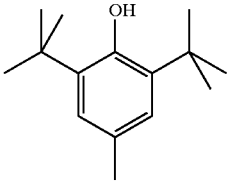

and 0.01 parts of a leveling solution (KF96; made by Shin-Etsu Chemical Co., Ltd.) into 1000 parts of THF. This first charge transfer layer application solution was applied onto the above charge generating layer via immersion, and a first charge transfer layer having a film thickness of 20 μm was formed by drying the application solution for 20 minutes at 60° C.

In addition, after 60 parts of G-700 polydialkylsiloxane-containing polycarbonate (made by Idemitsu Kosan Co., Ltd.; molecular weight of 70,000), 40 parts of the charge transfer material expressed via the formula (i) above, 1.2 parts of the oxidation inhibitor expressed via the formula (ii) above, and 0.01 parts of KF96 leveling agent (made by Shin-Etsu Chemical Co., Ltd.) were dissolved in 1000 parts of THF, 140 parts of PTFE dispersion solution (30% PTFE content) were added, and the contents were dispersed for 30 minutes via ultrasound, thereby creating a second charge transfer layer application solution. This solution was then applied onto the first charge transfer layer via the ring application method, and a second charge transfer layer having a film thickness of 7 μm was formed by drying the applied solution at 110° C. for 50 minutes. In this fashion, an photosensitive member having a layer for charge generation and a layer for charge transfer was obtained.

For the PTFE dispersion solution, a solution in which the dispersion solutions A1 and B1 described below were mixed together in equal proportions by weight was used.

The dispersion solution A1 was prepared by adding 300 parts of PTFE particles (TF9207; made by Sumitomo 3M Ltd.; particles having a primary particle diameter of 0.1 μm and a half-value width of 0.382) and 15 parts of GF-150 fluorine group-containing graft polymer (made by Toagosei Co., Ltd.) to 685 parts of toluene and dispersing the contents for 10 hours using a sand grinder.

The dispersion solution B1 was prepared by adding 300 parts of PTFE particles (KTL-500F; made by Kitamura Ltd.; particles having a primary particle diameter of 0.3 μm and a half-value width of 0.258) and 15 parts of GF-150 flourine group-containing graft polymer (made by Toagosei Co., Ltd.) to 685 parts of toluene and dispersing the contents for one hour using a sand grinder.

Example 2

A photosensitive member was created in the same manner as in connection with the Example 1, except that the PTFE dispersion solution was prepared by mixing together the dispersion solution A1 described above in connection with the Example 1 with the dispersion solution B2 described below in a weight ratio (A1:B2) of 6:4.

The dispersion solution B2 was prepared by adding 300 parts of L-2 particles (made by Daikin Industries Ltd.; primary particle diameter of 0.3 μm and half-value width of 0.313) and 15 parts of GF-150 flourine group-containing graft polymer (made by Toagosei Co., Ltd.) to 685 parts of toluene and dispersing the contents for five hours using a sand grinder.

Example 3

A photosensitive member was created in the same manner as in connection with the Example 1, except that the PTFE dispersion solution was prepared by mixing together the dispersion solution A1 described above in connection with the Example 1 with the dispersion solution B3 described below in a weight ratio (A1:B3) of 6:4.

The dispersion solution B3 was prepared by adding 300 parts of L-2 particles (made by Daikin Industries Ltd.; primary particle diameter of 0.3 μm and half-value width of 0.313) that were heated at 250° C. (resulting in a post-heating half-value width of 0.355) and 15 parts of GF-150 flourine group-containing graft polymer (made by Toagosei Co., Ltd.) to 685 parts of toluene and dispersing the contents for five hours using a sand grinder.

Example 4

A photosensitive member was created in the same manner as in connection with the Example 1, except that the PTFE dispersion solution was prepared by mixing together the dispersion solution A1 with the dispersion solution B1 in a weight ratio (A1:B1) of 8:2.

Example 5

A photosensitive member was created in the same manner as in connection with the Example 1, except that the PTFE dispersion solution was prepared by mixing together the dispersion solution A1 with the dispersion solution B2 in a weight ratio (A1:B2) of 2:8.

Comparison Example 1

A photosensitive member was created in the same manner as in connection with the Example 1, except that only the dispersion solution A1 was used as the PTFE dispersion solution.

Comparison Example 2

A photosensitive member was created in the same manner as in connection with the Example 1, except that only the dispersion solution B1 was used as the PTFE dispersion solution.

Comparison Example 3

A photosensitive member was created in the same manner as in connection with the Example 1, except that only the dispersion solution B2 was used as the PTFE dispersion solution.

Comparison Example 4

A photosensitive member was created in the same manner as in connection with the Example 1, except that only the dispersion solution B3 was used as the PTFE dispersion solution.

Comparison Example 5

A photosensitive member was created in the same manner as in connection with the Example 1, except that the PTFE dispersion solution was prepared by mixing together the dispersion solution A1 with the dispersion solution B1 in a weight ratio (A1:B1) of 9:1.

Comparison Example 6

A photosensitive member was created in the same manner as in connection with the Example 1, except that the PTFE dispersion solution was prepared by mixing together the dispersion solution A1 with the dispersion solution B2 in a weight ratio (A1:B2) of 1:9.

Results of Evaluation

The obtained photosensitive members were mounted in a commercially marketed MAGICOLOR 2200 DeskLaser color printer (made by Minolta-QMS K.K.) and the impact of wear on image quality was tested. Specifically, the halftone image and the surface of the photosensitive member were observed and evaluated for every 5000 sheets printed. Because agglomerations (coating defects) occurred on the outermost surface layers of the photosensitive members obtained as Comparison Examples 1 and 5, evaluation was not performed as to these examples. No agglomerations (coating defects) occurred on the outermost surface layers of the photosensitive members obtained as Examples 1–5. Agglomerations were detected using a microscope with a magnification of 10X.

○: No striations appeared on either the photosensitive member surface or the halftone image.

Δ: Although some light striations appeared on the photosensitive member surface, they were not present on the halftone image.

X: Striations clearly appeared on both the photosensitive member surface and the halftone image.

TABLE 1

| | Image Property | | | |
|---|---|---|---|---|
| | 5 K | 10 K | 15 K | 20 K |
| Example 1 | ○ | ○ | ○ | ○ |
| Example 2 | ○ | ○ | ○ | ○ |
| Example 3 | ○ | ○ | ○ | Δ |
| Example 4 | ○ | ○ | ○ | Δ |
| Example 5 | ○ | ○ | ○ | Δ |
| Comparison Example 1 | Agglomerations occurred. | | | |
| Comparison Example 2 | ○ | ○ | X | X |
| Comparison Example 3 | ○ | ○ | ○ | X |
| Comparison Example 4 | ○ | ○ | ○ | X |
| Comparison Example 5 | Agglomerations occurred. | | | |
| Comparison Example 6 | ○ | ○ | ○ | X |

K = 1000

What is claimed is:

1. A photosensitive member for electrophotography which comprises:

an electroconductive support and one or more layers that include a photosensitive layer formed on a surface of the electroconductive support, wherein (i) an outermost layer comprises a binder resin, fluororesin particles A and fluororesin particles B, (ii) the fluororesin particles A have an average primary diameter of less than 0.2 μm and a peak half-value width of the X-ray diffraction pattern of not less than 0.36, (iii) the fluororesin particles B have an average primary diameter of not less than 0.2 μm and a peak half-value width of the X-ray diffraction pattern of less than 0.36, and (iv) a weight ratio of the fluororesin particles A and the fluororesin particles B is within 8:2 to 2:8.

2. The photosensitive member in claim 1, wherein the weight ratio of the fluororesin particles A and the fluororesin particles B is within 7:3 to 3:7.

3. The photosensitive member in claim 2, wherein the fluororesin particles A have an average primary diameter of 0.01 to 0.15 μm, the fluororesin particles B have an average primary diameter of 0.25 to 9.39 μm, the fluororesin particles A have a peak half-value width of the X-ray diffraction pattern of 0.37 to 0.50, and the fluororesin particles B have a peak half-valve width of the X-ray diffraction pattern of 0.10 to 0.32.

4. The photosensitive member in claim 1, wherein the fluororesin particles A have an average primary diameter of 0.01 to 0.15 μm.

5. The photosensitive member in claim 1, wherein the fluororesin particles B have an average primary diameter of 0.25 to 0.39 μm.

6. The photosensitive member in claim 1, wherein the fluororesin particles A have a peak half-value width of the X-ray diffraction pattern of 0.37 to 0.50.

7. The photosensitive member in claim 1, wherein the fluororesin particles B have a peak half-value width of the X-ray diffraction pattern of 0.10 to 0.32.

8. The photosensitive member in claim 1, wherein the fluororesin particles A and B comprise polytetrafluoroethylene resin.

9. The photosensitive member in claim 1, wherein the total content of the fluororesin particles A and the fluororesin particles B is within 10 to 150 parts by weight to 100 parts by weight of the binder resin in the outermost layer.

10. The photosensitive member in claim 1, wherein the binder resin of the outermost layer is a polycarbonate having a recurring part expressed by the following formula:

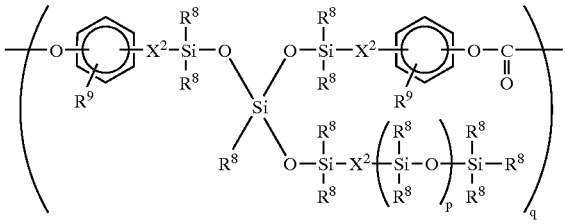

where $R^8$ represents an alkyl group having a carbon number from 1 to 6 or a substituted or non-substituted aromatic hydrocarbon radical having a carbon number from 6 to 12, multiple $R^8$'s may be either the same or different; $R^9$ represents a hydrogen atom, a halogen atom, an alkyl group having a carbon number from 1 to 6, or a substituted or non-substituted aromatic hydrocarbon radical having a carbon number from 6 to 12, multiple $R^9$'s may be the same or different; $X^2$ is $(CH_2)_k$, wherein multiple $X^2$'s may be the same or different; (k) is an integer from 1 to 6, (p) ranges between 0 and 200, and (q) ranges between 1 and 50.

11. A photosensitive member for electrophotography comprising a charge generating layer, a first charge transfer layer and a second charge transfer layer laminated on an electroconductive support in this order, wherein (i) the second charge transfer layer comprises a binder resin, a charge transfer material, fluororesin particles A and fluororesin particles B, (ii) the fluororesin particles A have an average primary diameter of less than 0.2 $\mu$m and a peak half-value width of the X-ray diffraction pattern of not less than 0.36, (iii) the fluororesin particles B have an average primary diameter of not less than 0.2 $\mu$m and a peak half-value width of the X-ray diffraction pattern of less than 0.36, and (iv) a weight ratio of the fluororesin particles A and the fluororesin particles B is within 8:2 to 2:8.

12. The photosensitive member in claim 11, wherein the binder resin of the second charge transfer layer is a polycarbonate having a part expressed by the following formula:

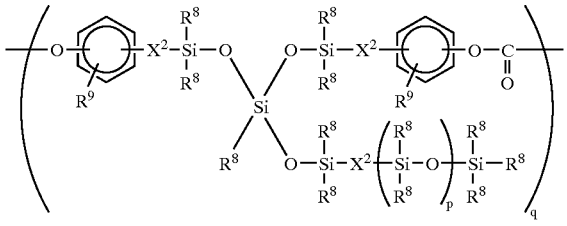

where $R^8$ represents an alkyl group having a carbon number from 1 to 6 or a substituted or non-substituted aromatic hydrocarbon radical having a carbon number from 6 to 12, multiple $R^8$'s may be either the same or different; $R^9$ represents a hydrogen atom, a halogen atom, an alkyl group having a carbon number from 1 to 6, or a substituted or non-substituted aromatic hydrocarbon radical having a carbon number from 6 to 12, multiple $R^9$'s may be the same or different; $X^2$ is $(CH_2)_k$, wherein the multiple $X^2$'s may be the same or different; (k) is an integer from 1 to 6, (p) ranges between 0 and 200, and (g) ranges between 1 and 50.

13. The photosensitive member in claim 11, wherein the fluororesin particles A and the fluororesin particles B comprise polytetrafluoroethylene resin.

14. The photosensitive member in claim 11, wherein the first charge transfer layer and/or the second charge transfer layer comprise an oxidation inhibitor selected from the group consisting of hindered phenols, hindered amines and benzotriazoles.

15. The photosensitive member in claim 11, wherein the fluororesin particles A have an average primary diameter of 0.01 to 0.15 $\mu$m.

16. The photosensitive member in claim 11, wherein the fluororesin particles B have an average primary diameter of 0.25 to 0.39 $\mu$m.

17. The photosensitive member in claim 11, wherein the fluororesin particles A have a peak half-value width of the X-ray diffraction pattern of 0.37 to 0.50.

18. The photosensitive member in claim 11, wherein the fluororesin particles B have a peak half-value width of the X-ray diffraction pattern of 0.10 to 0.32.

19. The photosensitive member in claim 11, wherein the total content of the fluororesin particles A and the fluororesin particles B is within 10 to 150 parts by weight to 100 parts by weight of the binder resin in the second charge transfer layer.

20. The photosensitive member in claim 19, wherein the fluororesin particles A have an average primary diameter of 0.01 to 0.15 $\mu$m, the fluororesin particles B have an average primary diameter of 0.25 to 0.39 $\mu$m, the fluororesin particles A have a peak half-value width of the X-ray diffraction pattern of 0.37 to 0.50, and the fluororesin particles B have a peak half-valve width of the X-ray diffraction pattern of 0.10 to 0.32.

* * * * *